United States Patent [19]

Rasheva et al.

[11] Patent Number: 4,669,087

[45] Date of Patent: May 26, 1987

[54] CONTROL SYSTEM FOR ELECTROSLAG REMELTING

[75] Inventors: Ivanka A. Rasheva, Sofia; Lyudmil K. Valkov, Pernik; Tzolo V. Rashev; Stoyan M. Stoyanov, both of Sofia, all of Bulgaria

[73] Assignee: Institute po Metaloznanie i Technologia na Metalite, Sofie, Bulgaria

[21] Appl. No.: 559,318

[22] Filed: Dec. 8, 1983

[30] Foreign Application Priority Data

Dec. 8, 1982 [BG] Bulgaria ..... 58843

[51] Int. Cl.[4] ..... H05B 3/60

[52] U.S. Cl. ..... 373/50

[58] Field of Search ..... 373/49, 50, 42, 47, 373/104, 105

[56] References Cited

U.S. PATENT DOCUMENTS 4,395,771 7/1983 Medovar et al. ..... 373/49

4,476,565 10/1984 Rashev et al. ..... 373/50

*Primary Examiner*—Roy N. Envall, Jr.

[57] ABSTRACT

Control system for electroslag remelting having a block for recording arc discharges, the input of which is connected to the current-carrying bus bar of a crystallization mold, while its output is connected to a block for switching over the rate of electrode feed, to the second input of which there is connected the output of a presetting block, and the output of the block for switching over the rate of feed of the electrode is connected via a regulator to an actuating mechanism. The current-carrying bus bar is connected to a block for recording the rectifier valve effect, the output of which is connected via a block for operation switch-over to a third input of the block for switching-over the rate of electrode feed.

2 Claims, 2 Drawing Figures

CONTROL SYSTEM FOR ELECTROSLAG REMELTING

Figure 1:
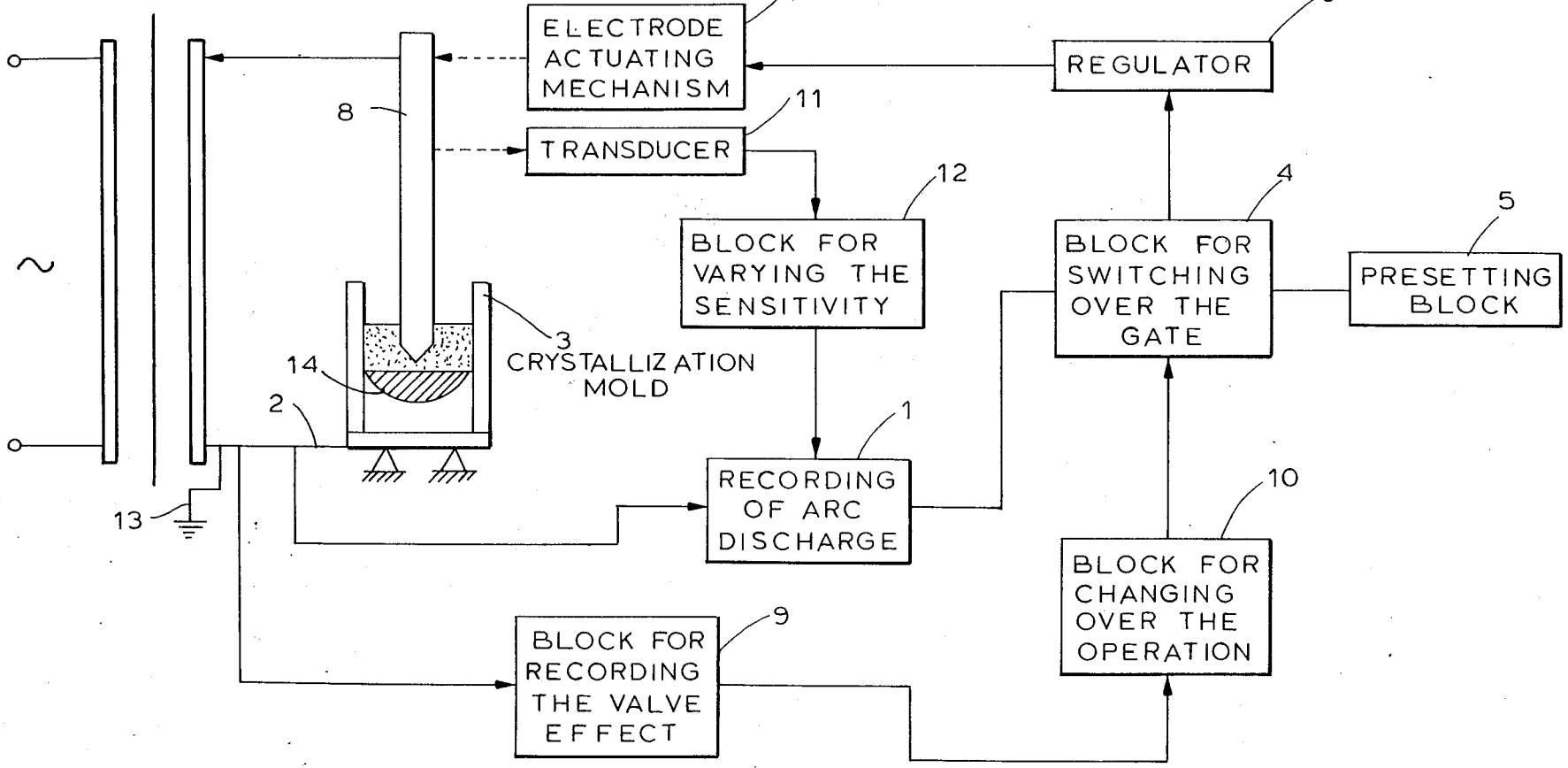

This invention relates to a control system for electroslag remelting, which can be used in the process of electroslag remelting of metals and alloys under atmospheric pressure, under pressure, or in a vacuum.

In a known control system for electroslag remelting (Bulgarian Pat. No. 34,784), the input of a separator filter with a preamplifier is connected via a connection to the current-conducting bus bar of a crystallization mold, while its output is connected in a series to a differential amplifier, an amplifier and an end stage, the output of which is connected to a trigger. The output of the trigger is connected via an electromagnetic relay to a switch for selecting operating conditions, which for its part is connected to a block for switching the rate of remelting, the output of which is connected to a regulator, the output of which is connected to an actuating mechanism for adjusting the electrode.

A drawback of this known system lies in that, in changing-over from the operation of melting the flux in a solid start to the operation of remelting, the switching is carried out manually by the operator; this is inaccurate, particularly if the process is conducted in a shielded system, and this results in a lower quality of ingots and a low productivity.

It is, therefore, a general object of this invention to provide a control system for electroslag remelting with automatic start, performance and termination of the process being carried out under conditions which are free of arc. This results in an improvement of the quality of the ingot, a reduction of energy consumption, the achievement of a reliable firing in the case of a solid start, and an increase of productivity.

This object is achieved by the provision of a control system for electroslag remelting, which comprises a block for measuring arc discharge, the input of which is connected to the current-carrying bus bar of the crystallization mold, while its output is connected to a block for changing the rate of electrode feed, to the second input of which there is connected the output of a presetting block, and the output of the block for switching-over the rate is connected via a regulator to an electrode actuating mechanism. The current-carrying bus bar is connected to a block for measuring the D.C. component, the output of which is connected via a block for operation switch-over to a third input of the block for changing the rate of electrode feed. The block for measuring the D.C. component comprises two equal current transformers, wound in one and the same direction on a current carrying bus bar, and at that, to the primary terminal of a first current transformer there is connected a first diode, and to it and to the final terminal of the first current transformer there is connected a first capacitor; to the final terminal of a second current transformer there is connected a second diode, and to it and to the primary terminal of a second current transformer there is connected a second capacitor. The common point between the first diode and the first capacitor is connected to the primary terminal of a second current transformer, while the common point between the second diode and the second capacitor is connected to the final terminal of the first current transformer.

The advantage of the system according to the invention are that the change-over from operation of firing with a solid or a liquid start to the operaion of remelting is effected automatically, this resulting in an improvement of the quality of the produced ingots; there is obtained information for the rectified current during the process, this providing a possibility for reduction of the energy losses and improvement of the productivity.

Figure 2:
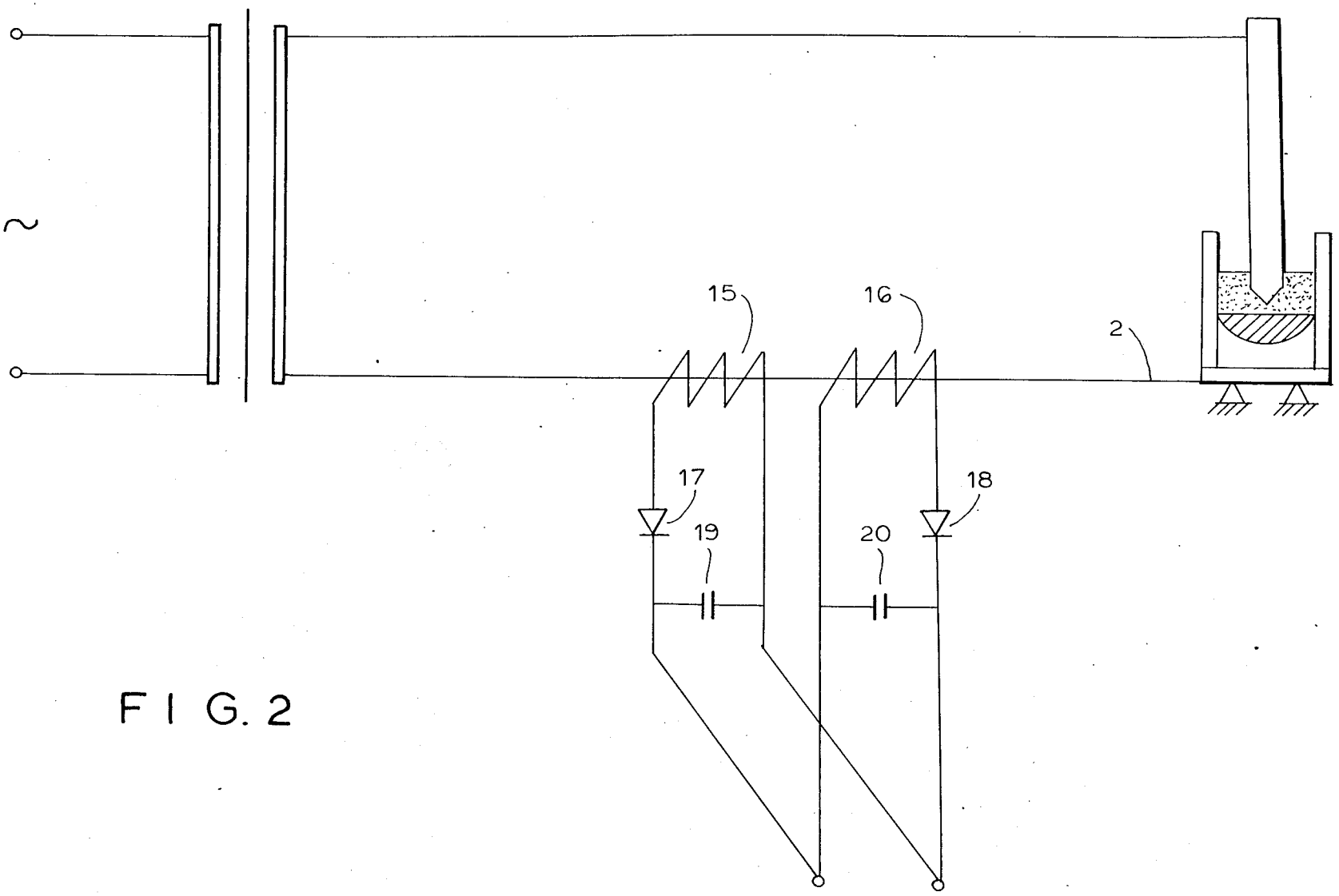

For a better understanding of the invention, reference should be made to the accompanying drawing in which there is illustrated a preferred embodiment of the control system for electroslag remelting according to the invention. In the drawings:

FIG. 1 is a block diagram of a control system for electroslag remelting in accordance with the invention; and FIG. 2 is a diagrammatical illustration of the device for measuring the D.C. component.

Turning first to FIG. 1, the control system comprises a block 1 for measuring arc discharges, the input is connected to a current-carrying bus bar 2 of a crystallization mold 3, while its output is connected to a block 4 for changing the rate of electrode feed, to the second input of which there is connected the output of a presetting block 5. The output of the block 4 for changing the rate of electrode feed is connected to a regulator 6, the output of which is connected to an electrode actuating mechanism 7, which is mechanically connected to the electrode 8. To a third input of the block 4 for changing the rate of electrode feed there is connected the output of the block 9 for measuring the D.C. component, via a block 10 for changing over the operation. The input of the block 9 for measuring the D.C. component is connected to the current-carrying bus bar 2. Moreover, the output of a transducer 11 for displacements of the electrode 8 is connected to the second input of the block 1 for measuring arc discharges via a block 12 for varying the sensitivity. The current-carrying bus bar 2 is grounded at point 13.

The device 15 (FIG. 2) for measuring the D.C. component comprises two equal current transformers—a first current transfomer 15 and a second current transformer 16, wound in one and the same direction with respect to the current-carrying bus bar 2. To the primary terminal of the first current transformer 15 there is connected a first diode 17, and to the final terminal of the second current transformer 16 there is connected a second diode 18, these two diodes being connected in one and the same direction, while to the first diode 17 and the final terminal of the first current transformer 15, as well as to the second diode 18 and the primary terminal of the second current transformer 16 there are connected, respectively, a first capacitor 19 and a second capacitor 20. The common point between the first diode 17 and the first capacitor 19 is connected to the primary terminal of the second current transformer 16, while the common point of the second diode 18 and the second capacitor 20 is connected to the final terminal of the first current transformer 15. The final terminal of the first current transformer 15 in the primary terminal of the second current transformer 16 are the output of the device 9 for measuring the D.C. component.

The operation of the control system for electroslag remelting in accordance with the present invention is as follows:

At the beginning of the process of electroslag remelting, a signal for current passing through the current-carrying bus bar 2 is received and amplified by the block 1 for measuring arc discharges, which feeds the signal to the block 4 for changing the rate of electrode feed. From the block 9 for measuring the D.C. component there is fed a signal for magnitude of the current of the D.C. component, which rises from 0 in the beginning of the process until reaching a preset value at the moment of formation of a slag bath. The melting of the solid flux, i.e. the firing of the furnace, is affected by feeding the electrode 8 at a preset rate of electrode feed when there is no signal form the block 1 for meausuring arc discharges, and in the case of a signal—the rate is zero. In the moment when there is received a signal from the block 9 and the current from the D.C. component has reached a preset value which insures the formation of a liquid slag bath, from the block 19 for operation changeover there is fed a signal to the block 4 for changing-over to the operation of remelting. At a signal for the occurence of arc discharges from the regulator 6, there is fed a signal to the actuating mechanism 7, which feeds the electrode at a rate lower than the average rate for the whole remelting, and if there is no signal, the rate of electrode feed is higher than the average rate. Moreover, such a layout of the system is possible, in which the rate of electrode feed is reduced gradually from a maximum value to zero in the case of a signal from block 1, and when there is no such signal, the rate increases until a new signal is received. Thus, it is possible for any moment of the process to achieve a self-determination of the most appropriate rate of electrode feed. At the end of remelting, a signal is fed from the transducer 11 to the electrode 8 indicating the end of the process of electroslag remelting, which via the block 12 for varying the sensitivity 12 increases the sensitivity of the block for measuring arc discharges 1, and at point the end of the electrode 8 is lifted and the remelting is gradually stopped. In the case of electrical industrial "noises", their interfering influence is eliminated by grounding at point 13.

During the performing of electroslag remelting, one part of the AC is rectified (D.C. component) and this results in a lower efficiency of the transformer to the oven. If there is no D.C. component current, the current at the output of the first and second current transformers 15 and 16 is zero. Upon the occurence of a D.C. component, since the rectification is unidirectional, there is obtained an overlapping of the current of the D.C. component on the one half-wave and the symmetry is disturbed, while at the output of the device 9 for measuring the D.C. component there is obtained a potential difference which is proportional to the magnitude of the D.C. component current.

Although the invention is described and illustrated with reference to a single embodiment thereof, it is to be expressly understood that it is in no way limited to the disclosure of such preferred embodiment but is capable of numerous modifications within the scope of the appended claims.

We claim:

1. A control system for electroslag melting and remelting, comprising an electrode (8) and a crystallization mold (3);

an electrode actuating mechanism (7);

a current carrying busbar (2) connected to said crystallization mold;

means (10) for changing from melting to remelting, said means having an input and an output;

means (9) for measuring the DC component of the current carried in said bus bar, said means having an input connected to said bus bar (2) and an output connected to the input of said means (10) for changing from melting to remelting;

means (5) for presetting the rate of feed of said electrode, said presetting means having an input and an output;

means (4) for changing the rate of feed of said electrode, said rate changing means having first, second and third inputs and an output, said first input being connected to the output of said presetting means (5), said second input being connected to the output of said means (10) for changing from melting to remelting;

means (1) for measuring arc discharges, said measuring means having a first and second input and an output, the first input being connected to said current carrying bus bar (2), and the output being connected to the third input of said means (4) for changing the rate of electrode feed, the second input of said measuring means (1) being connected through means for varying sensitivity (12) to a transducer (11) connected to said electrode (8);

the output of the rate changing means (4) being connected via a regulator (6) to said electrode actuating mechanism (7).

2. A control system as clained in claim 1 wherein the means (9) for measuring the DC component of the current carried in said bus bar (2) comprises a first current transformer (15) and a second current transformer (16), each transformer having a first and second terminal;

said transformers being wound in the same direction and disposed one after the other on said bus bar (2);

the first terminal of the first transformer (15) being connected through a first diode (17) and a first capacitor (19) to the second terminal of said first transformer (15);

the second terminal of the second transformer (16) being connected through a second diode (18) and a second capacitor (20) to the first terminal of said second transformer (16);

the common point of said first diode (17) and said first capacitor (19) being connected to the common point of said second capacitor (20) and said first terminal of said second transformer (16); and the common point of said second diode (18) and said second capacitor (20) being connected to the common point of said first capacitor (19) and said second terminal of said first transformer (15).

* * * * *